US005647595A

United States Patent [19]

Knickerbocker

[11] Patent Number: 5,647,595

[45] Date of Patent: Jul. 15, 1997

[54] MARBLE MAT

[76] Inventor: David F. Knickerbocker, 16202 Buccaneer La. #111, Houston, Tex. 77062

[21] Appl. No.: 625,195

[22] Filed: Apr. 1, 1996

[51] Int. Cl.[6] ..... A63F 9/00

[52] U.S. Cl. ..... 273/118 R; 273/286; 220/62.1

[58] Field of Search ..... 383/4, 105, 123; 220/7, 62.1, 656, 657, 658, 659; 206/579, 315.1; 273/411, 285, 286, 118 R, 342, 353, 336, 127 B, 424, DIG. 30, 337, 338, 339, 425, 309

[56] References Cited

U.S. PATENT DOCUMENTS

| | | | |
|---|---|---|---|
| 975,009 | 11/1910 | Wright et al. | 273/118 R |
| 991,523 | 5/1911 | McClay . | |
| 1,325,103 | 12/1919 | Miller . | |
| 1,467,690 | 9/1923 | Schwarz . | |
| 1,708,318 | 4/1929 | Mellen . | |
| 2,636,740 | 4/1953 | McNeal | 273/118 |
| 2,943,858 | 7/1960 | Slater | 273/118 |
| 3,537,116 | 11/1970 | Kain | 5/420 |
| 4,345,760 | 8/1982 | Kovach | 273/118 R |
| 4,709,928 | 12/1987 | Willingham | 273/309 |
| 4,848,772 | 7/1989 | Lewis et al. | 273/286 |
| 4,952,073 | 8/1990 | Wieland | 273/336 |
| 4,989,880 | 2/1991 | Gettemeier et al. | 273/DIG. 30 |
| 5,203,571 | 4/1993 | Fischer | 273/286 |
| 5,382,022 | 1/1995 | Cook et al. | 273/118 R |

*Primary Examiner*—William M. Pierce
*Attorney, Agent, or Firm*—Harrison & Egbert

[57] ABSTRACT

An apparatus for playing marbles including a first layer of foam material having an upturned perimeter for retaining marbles therewithin and a second layer of foam material affixed to an upper surface of the first layer and within the upturned perimeter. The first layer has a lip affixed thereto inwardly of perimeter and beyond an edge of the second layer. The lip extends transversely outwardly from the upper surface of the first layer. The lip is formed of a strip of foam material adhesively affixed to the upper surface of the first layer. The first layer is formable between a flat configuration and a bowl-shaped configuration. The first layer has a generally rectangular configuration with inwardly radiused corners when in the flat configuration. A hook-and-loop fastener is affixed to each of the radiused corners for forming the first layer into a bowl-shaped configuration.

12 Claims, 1 Drawing Sheet

MARBLE MAT

TECHNICAL FIELD

The present invention relates to apparatus for the playing of marbles. More particularly, the present invention relates to apparatus which form a playing surface for the game of marbles.

BACKGROUND ART

Marble games have been played for many years in a scheme wherein the players present marbles from their personally owned collection into an appointed target area. The various players take turns in knocking the marbles out by the means of shooter marbles which they project into the target area. The objective of some marble games As to capture and win the possession and ownership of as many marbles as possible from those presented to the game from various players. Thus, the winner not only wins by numerically taking possession of the most marbles, but also becomes the possessor and owner of the marbles.

Marbles may be made of any materials but are usually glass, although sometimes marbles are steel. The playing surface for marble games is usually a relatively flat surface, the composition of which may be a dry material such as compacted earth, textured carpeting, or artificial carpet grass upon which the marbles will roll. The surface should have some texture so that the marbles come to a stop by gravity and friction in a short space.

In the past, the surfaces upon which the game of marbles is played is irregular. As was stated previously, the game of marbles can be played on carpeting, on grass, on concrete, or on various other surfaces. In many circumstances, the marbles are quickly lost in the environment in which the marble game is played. Ideally, it is preferable to play the game in an area in which the marbles can be retained after the shooting of the marbles. Additionally, the texture upon which the game is played can greatly affect the uniformity of results. As such, a uniform texture, as closely resembling the earth as possible, is desired.

In the past, various patents have issued relating to playing surfaces for the game of marbles. For example, U.S. Pat. No. 2,636,740, issued on Apr. 28, 1953, to O. C. McNeal describes a device for the playing of a game of marbles. In this device, a marble-playing table of wood, fiberboard, hard plastic, or other rigid material is provided. The board is circular and is supported by a plurality of relatively short supporting blocks or legs secured to the underside of the table. A marble-deflecting shield of shock-absorbent material is connected to the table. This provides an annular trough for retrieving marbles shot from the table. The shield is a wide band of soft, flexible fabric having opposite or inner and outer edges hemmed over bands of elastic or yieldingly expansible material. This device provides a suitable cover which can be applied to the table so as to simulate, as nearly as possible, the usual surface conditions under which marbles are played outdoors.

U.S. Pat. No. 2,943,858, issued on Jul. 5, 1960, to F. W. Slater describes a ring-like device for the playing of marbles. This device includes a circular flat base made of a suitable plastic that retains a flat shape when extended, but is of a type that can be rolled up or folded. A raised portion, in the form of a hollow tube, is connected to the periphery of the flat base. This tube forms a retaining wall for the marbles whereby they cannot be scattered all over the area adjacent to which the game is played. A circular piece of material is bonded to the top surface of the base so as to form the marble court. This material may be of felt or sponge rubber suitably bonded to the base or it may be formed by spraying plastic onto the base.

U.S. Pat. No. 4,345,760, issued on Aug. 24, 1982, to J. J. Kovach describes an educational marble game in which the players project marbles on a textured game board carpet on which indicia are presented having unnamed geographical significance. In this game, the players project marbles onto surfaces of the game board so as to learn geographical facts.

U.S. Pat. No. 4,709,928, issued on Dec. 1, 1987, to W. P. Willingham describes a circular game board foldable into thirds for storage. This game board comprises a circular playing surface bounded by a generally tubular member affixed around the periphery of the playing surface. An elongate spring-like member is disposed in the tubular member. An appropriate device is used for securing the ends of the spring-like member together so as to create an endless ring. This ring serves to keep the playing surface taut.

U.S. Pat. No. 1,708,318, issued on Apr. 9, 1929, to M. Melen describes a game table surface which is of a generally rectangular configuration having cutout rectangular corners.

It is an object of the present invention to provide a marble mat that can be used to play the game of marbles.

It is another object of the present invention to provide a marble mat that effectively simulates the playing of the game of marbles on the earth.

It is another object of the present invention to provide a marble mat that can retain the marbles during the game.

It is a further object of the present invention to provide a marble mat which can be assembled and disassembled for play and for storage.

It is a further object of the present invention to provide a marble mat which provides a support surface for the shooter's hand.

It is still another object of the present invention to provide a marble mat that is easy to use, easy to manufacture, and relatively inexpensive.

These and other objects and advantages of the present invention will become apparent from a reading of the attached specification and appended claims.

SUMMARY OF THE INVENTION

The present invention is an apparatus for playing marbles that comprises a first layer of foam material having an upturned perimeter for retaining marbles therewithin and a second layer of foam material affixed to an upper surface of the first layer within the upturned perimeter.

The first layer has a lip affixed thereto inwardly of the perimeter and beyond an edge of the second layer. The lip extends transversely outwardly from the upper surface of the first layer. This lip is positioned inwardly of the perimeter by approximately one inch and positioned approximately two inches above the second layer. The lip is formed of a strip of foam material adhesively affixed to the upper surface of the first layer.

The first layer is formable between a flat configuration and a bowl-shaped configuration. The upturned perimeter is formed when the first layer is in its bowl-shaped configuration. The first layer has a generally rectangular configuration with inwardly radiused corners when in the flat configuration. Each of the radiused corners has a hook-and-loop fastener affixed thereto. This hook-and-loop fastener serves to form the first layer into the bowl-shaped configuration.

The foam material of the first and second layers is of an open-cell polyurethane foam material. The open-cell polyurethane foam of the second layer is of a different density than the polyurethane foam material of the first layer.

The second layer has a generally rectangular configuration. The rectangular configuration of the second layer has a circled area formed therein for the playing of the game of marbles.

DETAILED DESCRIPTION OF THE INVENTION

Figure 1:
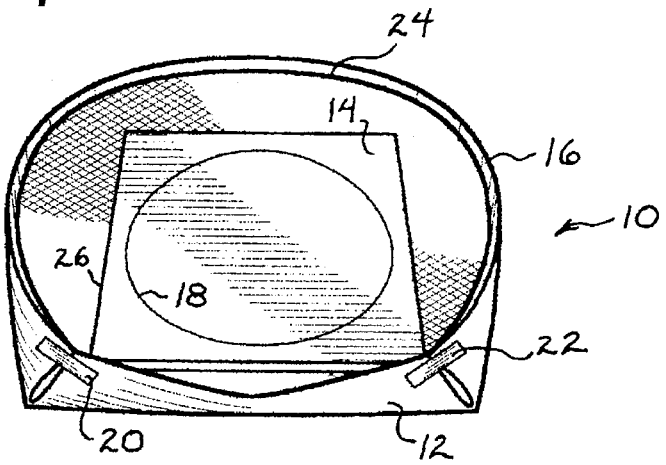
FIG. 1 is a perspective view of the present invention in its assembled bowl-shaped configuration.

Referring to FIG. 1, there is shown at 10 the marble mat in accordance with the preferred embodiment of the present invention. The marble mat 10 includes a first layer 12 of foam material and a second layer 14 of foam material. The first layer 12 has an upturned perimeter 16 so as to retain marbles therewithin. The second layer 14 is affixed to an upper surface of the first layer 12 within the area of the upturned perimeter 16. As can be seen in FIG. 1, the second layer 14 includes a circled area 18 formed thereon for the playing of the game of marbles.

The first layer 12 is of a open-cell polyurethane foam material. Such polyurethane foam material can be easily foldable for storage and can be easily assembled into the configuration of FIG. 1. The configuration of FIG. 1 shows the first layer 12 in a bowl-shaped configuration. The upturned perimeter will have an upper edge approximately three inches above the playing surface of the second layer 14.

Importantly, in FIG. 1, it can be seen that the first layer 12 of the marble mat 10 is assembled into its bowl-shaped configuration. The assembling is accomplished by connecting the corners of the first layer 12 through the use of hook-and-loop material strips 20 and 22. The hook-and-loop material strips 20 and 22 are otherwise known as VELCRO (™) material. The hook-and-loop material strips 20 and 32 are secured to the opposite side of the first layer 12 from that of the second layer 14. The hook-and-loop material strips 20 and 22 are configured so as to secure the edges together in an upturned configuration. Additional hook-and-loop material strips are also provided on the opposite end of the first layer 12 (not shown). The use of such hook-and-loop material greatly facilitates the assembling of the first layer 12 into its bowl-shaped configuration. This arrangement avoids the need of snaps, buckles, buttons, or other devices that can be somewhat difficult to use. Additionally, the use of such hook-and-loop material strips 20 and 22 allows the first layer 12 to be configured in a generally flat configuration for storage. The strips 20 and 22 can also be used so as to securely fold the first layer 12 into a compact configuration for storage.

It can be seen in FIG. 1 that a lip 24 is affixed to an upper surface of the first layer 12. The lip 24 is affixed to the first layer so as to extend inwardly of the perimeter 16 and beyond the outer edge 26 of the second layer 14. When the first layer 12 is formed into its bowl-shaped configuration, the lip 24 will generally extend around the interior of the bowl-shaped configuration. The lip 24 will extend transversely outwardly of the upper surface of the first layer 12. In the preferred embodiment of the present invention, the lip 24 is positioned inwardly of the perimeter edge 16 by approximately one inch. The lip 24 will reside approximately two inches above the second layer 14. The lip 24 is provided so as to be in a proper position for retaining the marbles within the marble mat 10. If the lip 24 were not provided, then it would be possible for marbles to "jump" from the second layer 14 and over the top edge 16 of the first layer 12. Although it is believed that the marble mat 10 of the present invention would work effectively without the lip 24, the lip 24 has been provided so as to more securely retain the marbles within the interior of the marble mat 10. The lip 24 is generally formed of a strip of foam material which is adhesively affixed to the upper surface of the first layer 12.

The second layer 14 is also formed of a open-cell polyurethane foam material. The open-cell polyurethane material used for the second layer 14 has been found to have a texture which resembles, as closely as possible, the texture of the earth. By selecting such a polyurethane foam material, the second layer 14 will perform virtually identical to that of the earth. As such, the second layer 14 will provide a most effective playing surface for the game of marbles.

The second layer 14 is adhesively affixed to a top surface of the first layer 12. As can be seen in FIG. 1, the second layer 14 has a circle 18 formed therein. The circle 18 is the playing area for the game of marbles. The second layer 14 is a generally rectangular configuration which extends entirely on the flat portion of the first layer 12. In the preferred embodiment of the present invention, the open-cell polyurethane foam material of the second layer 14 will have a different density and thickness than that of the first layer 12.

A unique advantage to the present invention is the use of the upturned perimeter 16 as a "support" for the hand of the shooter. In a conventional game of marbles, the shooter will position his or her hand on the earth. If the surface upon which the shooter's hand is positioned is uneven or uncomfortable, the shooter may place his or her hand upon the back side of the other hand for support. In the marble mat 10 of the present invention, the upturned surface of the first layer 12 provides a convenient and cushioned support for the hand of the shooter. As such, it provides more consistency in the playing of the game of marbles.

Figure 2:
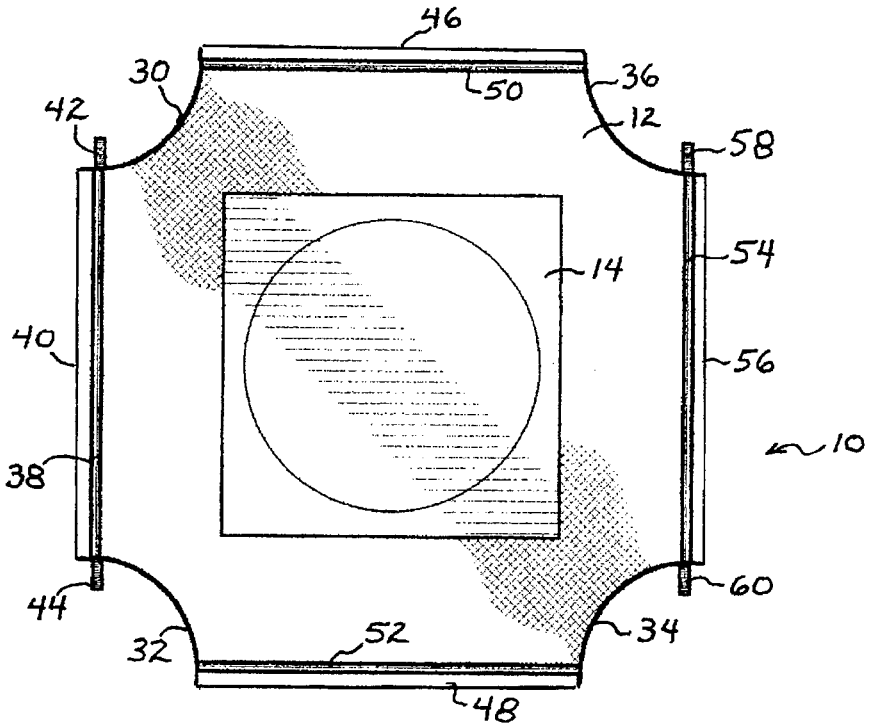
FIG. 2 is a plan view of the present invention in its unassembled flat configuration.

FIG. 2 shows the marble mat 10 in its unassembled flat condition. Initially, it can be seen that the first layer 12 has a generally rectangular configuration with radiused corners 30, 32, 34, and 36. The radiused corners 30, 32, 34, and 36 extend inwardly from the rectangular configuration of the first layer 12. In FIG. 2, it can be seen that a lip portion 38 extends parallel to the outer edge 40 of the first layer 12 and extends between the radiused areas 30 and 32. The hook-and-loop material strip 42 will extend outwardly toward the radiused area 30. Another hook-and-loop material strip 44 will extend outwardly into the radiused area 32. The hook-and-loop material strips 42 and 44 are suitable for joining with the edges 46 and 48, respectively, of the first layer 12. The lip portion 50 extends inwardly of the outer edge 46. Similarly, the lip portion 52 will extend inwardly of the edge 48. When the hook-and-loop material strips 42 and 44 are joined to the edges 46 and 48, respectively, the lip portions 50 and 52 will generally align with the lip portion 38. The radiused portions 30 and 32 will be sufficiently closed so as to prevent the escape of marbles therethrough.

The lip portion 54 extends generally parallel to the edge 56. The hook-and-loop material strips 58 and 60 extend outwardly from the edge 58. The hook-and-loop material strip 54 is suitable for joining with the edge 46 of the first layer 12. Similarly, the hook-and-loop material strip 60 is suitable for joining with the outer surface of the edge 48. The joining of the hook-and-loop material strips 58 and 60 will be suitable for closing the radiused portions 36 and 34, respectively, so as to prevent the escape of the marbles. When the hook-and-loop material strips 58 and 60 are joined to the edges 46 and 48, respectively, the lip 54 will be aligned with the lips 50 and 52 on the interior of the bowl-shaped configuration of the first layer 12.

It can be seen in FIG. 2 that the second layer 14 has a generally rectangular configuration which is centered upon the upper surface of the first layer 12. The second layer 14 will reside on the flat portion of the bowl-shaped configuration of the first layer 12. As shown in FIG. 2, it can be seen how the marble mat 10 of the present invention can be easily rolled up, folded, or packaged for storage. Since both the first layer 12 and the second layer 14 are of a foam material, they can be easily compressed so as to occupy a small space for shipment, storage and/or sale.

Figure 3:
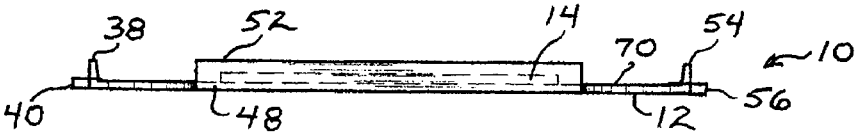
FIG. 3 is a cross-sectional view of the present invention in its flat unassembled configuration.

Referring to FIG. 3, it can be seen that the marble mat 10 has a first layer 12 of a generally flat configuration and a second layer 14 extending upwardly from the top surface 70 of the first layer 12. The lips 38 and 54 also extend upwardly from the top surface 70 generally transversely to the top surface 70 of the first layer 12. The lip 38 is positioned inwardly of the outer edge 40. Similarly, the lip 54 is positioned inwardly of the outer edge 56.

In FIG. 3, it can also be seen that the lip 52 extends upwardly from the edge 48. The second layer 14 is shown in its flat configuration entirely within the edges of the first layer 12.

The present invention greatly facilitates the playing of the game of marbles. Since the configuration of the present invention greatly matches the conditions of the earth, a uniform game of ideal conditions is provided. The upturned perimeter of the marble mat 10 of the present invention provides a cushioned support for the hand of the shooter. Additionally, the upturned perimeter 16 will serve to properly retain the marbles within the area of the marble mat 10. The lip 24, which extends around the interior of the bowl-shaped configuration of the first layer 12, will prevent any marbles from escaping from the marble mat 10. The foam configuration of the marble mat 10 greatly facilitates the shipment, transport, and storage of the marble mat 10. It also serves to greatly reduce the weight and to increase the transportability of the mat 10.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. An apparatus for playing marbles comprising:

a first layer of foam material, said first layer having a perimeter for retaining marbles therewithin; and a second layer of foam material affixed to an upper surface of said first layer within said perimeters, said first layer having a lip affixed thereto inwardly of said perimeter and beyond an edge of said second layer, said lip extending transversely outwardly of said upper surface of said first layer, said lip positioned inwardly of said perimeter by approximately one inch, said lip positioned approximately two inches above said second layer, said lip being formed of a strip of said foam material and adhesively affixed to said upper surface of said first layer.

2. The apparatus of claim 1, said first layer being sufficiently flexible so as to be formable into a bowl-shaped configuration.

3. The apparatus of claim 2, said first layer having a generally rectangular configuration with inwardly radiused corners.

4. The apparatus of claim 3, each of said radiused corners having a hook-and-loop fastener affixed thereto, said hook-and-loop fastener for forming said first layer into said bowl-shaped configuration.

5. The apparatus of claim 1, said foam material of said first and second layers being of an open-cell polyurethane foam.

6. The apparatus of claim 5, said open-cell polyurethane foam of said second layer being of a different density than said first layer.

7. The apparatus of claim 1, said second layer having a generally rectangular configuration, said rectangular configuration of said second layer having a circled area formed therein.

8. An apparatus for playing marbles comprising:

a first layer of material being of sufficient flexibility so as to be formable between a flat configuration and a bowl-shaped configuration, said bowl-shaped configuration having a flat interior surface and an upturned perimeter; and a second layer of material affixed to said flat interior surface of said first layer, said second layer having a circled area formed thereon, said first layer having a generally rectangular configuration with radiused corners when in said flat configuration, said first layer having a lip formed thereon, said lip extending transversely outwardly therefrom and extending between said radiused corners, said lip extending generally parallel to and inwardly of an outer edge of said first layer, said lip being a strip of a foam material, said strip being adhesively affixed to an upper surface of said first layer.

9. The apparatus of claim 8, each of said radiused corners having a hook-and-loop fastener affixed thereto, said hook-and-loop fastener for forming said first layer into said bowl-shaped configuration.

10. The apparatus of claim 8, each of said first and second layers being of a foam material.

11. The apparatus of claim 10, said foam material being of an open-cell polyurethane foam, the foam of said first layer having a different density than the foam of said second layer.

12. The apparatus of claim 8, said second layer being adhesively affixed to said upper surface of said first layer.

* * * * *